US005145079A

United States Patent [19]

Woodrow et al.

[11] Patent Number: 5,145,079

[45] Date of Patent: Sep. 8, 1992

[54] TAMPER-EVIDENT OVERCAP

[75] Inventors: James R. Woodrow, Glenview; William J. Thomas, Bolingbrook Court, both of Ill.

[73] Assignee: Continental White Cap, Inc., Downers Grove, Ill.

[21] Appl. No.: 483,871

[22] Filed: Feb. 23, 1990

[51] Int. Cl.[5] ..... B65D 50/00

[52] U.S. Cl. ..... 215/232; 215/252; 215/256; 215/253; 215/251

[58] Field of Search ..... 215/230, 232, 252, 256, 215/253, 278, 274, 251

[56] References Cited

U.S. PATENT DOCUMENTS

| | | | |
|---|---|---|---|
| 958,887 | 5/1910 | Parmele | 215/252 |
| 2,390,296 | 12/1945 | Blackman | 215/252 |
| 3,088,830 | 5/1963 | Graham | 215/253 |
| 3,164,314 | 1/1965 | Waycie | 229/1.5 B |
| 3,272,367 | 9/1966 | Long | 215/278 |
| 3,951,292 | 4/1976 | Amberg | 215/252 |
| 3,983,645 | 10/1976 | Rycroft | 215/232 |
| 4,424,911 | 1/1984 | Resnick | 215/230 |
| 4,464,158 | 8/1984 | Kardon | 229/80 |
| 4,480,760 | 11/1984 | Schonserger | 215/230 |
| 4,489,841 | 12/1984 | Thompson | 215/230 |
| 4,511,052 | 4/1985 | Klein et al. | 215/230 |
| 4,576,298 | 3/1986 | Boik | 215/252 |
| 4,733,787 | 3/1988 | Knopf et al. | 215/251 |

*Primary Examiner*—Stephen Marcus
*Assistant Examiner*—Paul A. Schwarz
*Attorney, Agent, or Firm*—Lockwood, Alex, FitzGibbon & Cummings

[57] ABSTRACT

This relates to a tamper-evident overcap for packages of the type which include a container that is sealed closed by means of a removable closure. The overcap is preformed and shaped to tightly telescope over both the skirt of the closure and an upper part of the container body and is bonded to the closure skirt in the container body utilizing an adhesive. The collar of the overcap also includes an intermediate portion joining the portions bonded to the closure and the container and the intermediate portion is provided with a circumferential weakening line to facilitate separation of the two parts of the collar when the closure is to be removed. The collar may also be provided with suitable stripes of a coating containing microcapsules in which there is packaged a suitable FDA approved dye or coloring so that when the microcapsules are ruptured, the overcap will be stained so as to indicate tampering.

20 Claims, 1 Drawing Sheet

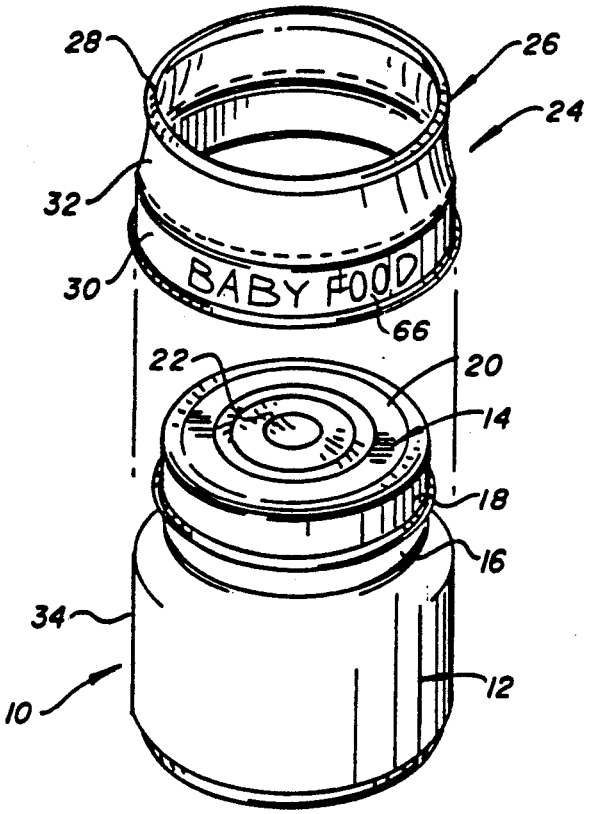
FIG. 1
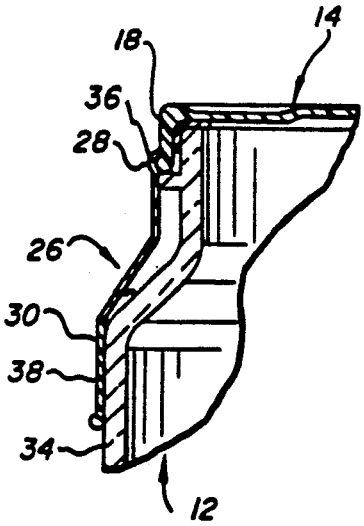
FIG. 3
FIG. 2
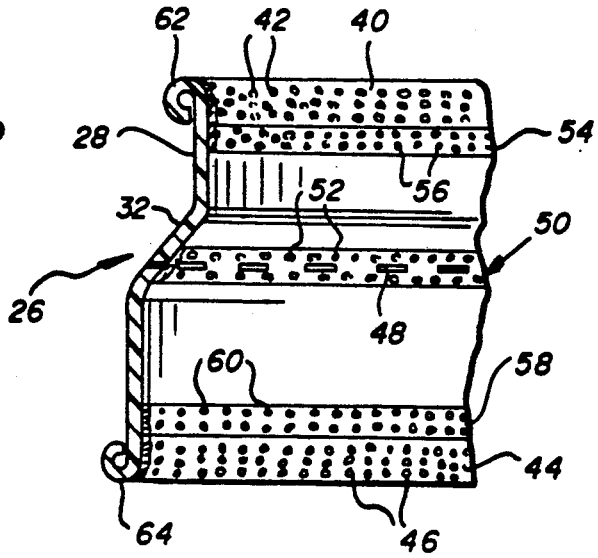

TAMPER-EVIDENT OVERCAP

This invention relates to an overcap for a package of the type including a container and a removable closure. Most specifically, the overcap is in the form of a preformed collar which is adhesively bonded to both the closure and the container and is provided with a line of weakening along which the overcap ruptures during the removal of the closure from the container.

A common form of providing tamper-evidence to a package is the use of a plastic band which is placed over a sealed package, put through a heat chamber and shrunk against the package. A concern about this type of tamper-evident device is that exposure to heat can expand the plastic and defeat the system.

According to this invention, there is provided an alternative approach of applying a tamper band and to make the band undefeatable and irreversable. The tamper band would be made out of a material similar to that used in paper drinking cups, or could be formed of plastic which is either thermoformed or injection molded.

The preformed collar would be dropped over a sealed package and utilize adhesive to adhere the collar to both the closure and the container. The collar would be provided with a circumferential line of weakening, preferably perforation, to allow for separation of upper and lower portions upon opening of the container.

A microcapsule coating could be applied to the inside of the collar so that any attempt to remove the bond at either the top or the bottom of the collar would result in the rupture of microcapsules and release of a FDA approved dye or colorant.

Under normal opening conditions, the tearing of the collar along the perforated line or other line of weakening would also result the rupture of microcapsules carrying a dye, thereby providing for an irreversable color change.

If desired, the adhesive utilized to bond the collar to the closure and the container could be packaged in microcapsules which are openable when pressure is applied between the collar on the one hand and the closure and container on the other hand.

Further, the tamper band could be preprinted and serve as a label for the package.

With the above and other objects in view that will hereinafter appear, the nature of the invention will be more clearly understood by reference to the following detailed description, the appended claims, and the several views illustrated in the accompanying drawings.

FIG. 1, is an exploded perspective view showing a conventional closed container and a collar formed in accordance with this invention to become an overcap for that container.

FIG. 2 is an enlarged fragmentary sectional view taken through the collar and shows the specific configuration of the collar and bands of microcapsules applied thereto.

FIG. 3 is an enlarged fragmentary vertical sectional view taken through an upper portion of a sealed package with the tamper-evident overcap applied thereto.

Referring now to the drawings in detail, reference is first made to FIG. 1 wherein there is illustrated a customary package, generally identified by the numeral 10. The package 10 includes a container 12 which is closed by means of a removable closure 14. The container 12 preferably includes a neck portion 16 of a reduced diameter which is engaged by a skirt portion 18 of the closure 14.

A typical example of the package 10 would be a jar of baby food which could be vacuum packed. In such event, the closure 14 would include an end wall 20 having a central bubble 22.

In FIG. 1 there is also illustrated separate and apart from the package 10 a tamper-evident overcap formed in accordance with this invention and generally identified by the numeral 24. The overcap 24 is preferably in the form of a collar 26 which includes an upper cylindrical portion 28 and a lower cylindrical portion 30 joined by an integral intermediate portion 32. The upper cylindrical portion 28 is of a size and shape to tightly engage a lower portion of the skirt 18 while the lower portion 30 is of a size and shape to tightly engage an upper part of a body 34 of the container 12 Since the outer diameter of the skirt 18 is less than the outer diameter of the upper portion of the body 34, it will be seen that the collar 26 may be readily dropped into place in telescoping relation to the upper part of the package 10.

With reference to FIG. 3, it will be seen that the upper portion 28 of the collar 26 will be bonded to the skirt 18 by means of suitable adhesive 36. In a like manner, the lower portion 30 of the collar 26 will be bonded to the upper part of the body 34 of the container 12 by way of a suitable adhesive 38.

The adhesive layers 36, 38 will be preferably pressure operative. In a preferred embodiment of the invention, the adhesive 36 will be incorporated in a coating 40 carrying a plurality of microcapsules 42 in which the adhesive 36 is packaged. In a like manner, the interior of the lower portion 30 of the collar 26 will be provided with an annular coating 44 containing readily rupturable microcapsules 46 in which the adhesive 38 is packaged.

When the collar 26 is forced down on to the package 10, the microcapsules 42 and 46 will be ruptured due to the pressure engagement of the collar 26 with both the closure 14 and the container 12. This will release the adhesive 36 and 38 and permit the bonding of the collar 26 to both the closure 14 and the container 12.

It is also feasible to utilize a suitable pressure sensitive adhesive.

In accordance with this invention, it is intended that when the closure 14 is removed, the collar 26 will be split into two parts. In order to facilitate this, the intermediate portion 32 is provided with a line of weakening 48 which may be in the form of perforations as is clearly illustrated in FIG. 2.

In order to clearly indicate tampering, the inner surface of the intermediate portion 32 of the collar 26 is provided with an annular stripe-like coating 50 which is generally aligned with and is disposed on both sides of the line of weakening 48. The coating 50 will contain a plurality of microcapsules 52 which contain a suitable FDA approved dye or coloring The microcapsules 52 are readily rupturable so as to automatically release the dye. The dye will stain the intermediate portion 32 of the collar 26 to clearly indicate tampering.

It is also considered the possibility of the adhesive 36 being separated from either the collar 26 or the closure 14 which would defeat the provision of the overcap 24. Accordingly, to this end, the inner surface of the upper portion 28 of the collar 26 will be provided with a second coating 54 which carries a plurality of microcapsules 56 in which a suitable FDA approved dye or coloring will be packaged. Thus, any attempt to eliminate the adhesive bond between the collar 26 and the closure 14 will result in the rupturing of certain of the microcapsules 56 to release the dye with the dye producing a stain to indicate tampering. The same will occur if any of the upper portion 28 is cut or otherwise ruptured.

In a like manner, means are provided for indicating tampering with the adhesive bond between the lower portion 30 of the collar 26 and the body 34 of the container 12. To this end, yet another band of coating 58 is provided. The coating 58 will have incorporated therein microcapsules 60 carrying further amounts of the FDA approved dye or coloring. Thus, if one attempts to separate the collar 26 from the container 12, one will rupture certain of the microcapsules 60 and release the dye or coloring which will stain the lower portion 30 of the collar 26 to indicate tampering.

The illustrated collar 26 has been formed of a suitable paper similar to that utilized in making paper cups. The and lower edges of the collar 26 have been reinforced by way of curls 62, 64. Also, as is clearly shown in FIG. 1, the exterior of the collar 26 may be provided with suitable indicia 66 which could also function as a label for the package 10.

Finally, it is to be understood that the collar 26 could be formed either by thermoforming plastic sheet material or by injection molding. However, since all three forms of collars would have the same appearance, no attempt has been made to specifically illustrate the collars formed of plastic in that they will have the same configuration as the paper collar 26 except for, possibly, the curls 62, 64.

Although only a preferred embodiment of the tamper evident overcap has been specifically illustrated and described herein, it is to be understood that minor variations may be made therein without departing from the spirit and scope of the invention as defined by the appended claims

We claim:

1. A tamper-evident overcap for application to a closed container including a removable closure, said overcap being in the form of a preshaped collar including an upper portion of a size and shape to be bonded to a closure without change in size or shape, a lower portion of a size and shape to be bonded to a container without change in size or shape, and an intermediate portion integrally joining said upper and lower portion, said intermediate portion having a line of weakening for separating said upper portion from said lower portion when said upper portion is to be removed, and means for irreversibly indicating manipulation of the line of weakening.

2. An overcap according to claim 1 wherein said upper and lower portions have internal surfaces carrying an adhesive for separately bonding said overcap to a container and a closure for such container.

3. An overcap according to claim 2 wherein said adhesive is a pressure activated adhesive.

4. An overcap according to claim 2 wherein said adhesive is a pressure activated adhesive wherein said adhesive is stored in rupturable microcapsules.

5. An overcap according to claim 1 wherein said overcap includes a coating of microcapsules containing a color forming dye whereby when said overcap is ruptured, ruptured portions of said overcap automatically become stained.

6. An overcap according to claim 5 wherein said coating of microcapsules containing of color forming dye is along said line of weakening.

7. An overcap according to claim 5 wherein said coating of microcapsules containing a color forming dye is carried by said upper and lower portions.

8. An overcap according to claim 2 wherein said overcap includes a coating of microcapsules containing a color forming dye whereby when said overcap is ruptured, ruptured portions of said overcap automatically become stained.

9. An overcap according to claim 8 wherein said coating of microcapsules containing a color forming dye is along said line of weakening.

10. An overcap according to claim 8 wherein said coating of microcapsules containing a color forming dye is carried by said upper and lower portions.

11. An overcap according to claim 1 wherein said preshaped collar is formed of paper.

12. An overcap according to claim 1 wherein said preshaped collar is formed of paper and has curled upper and lower reinforcing edges.

13. An overcap according to claim 1 wherein said preshaped collar is formed of plastic.

14. An overcap according to claim 1 wherein said preshaped collar is formed of injection molded plastic.

15. An overcap according to claim 1 wherein said upper and lower portions are generally cylindrical and of different diameters with the diameter of said lower portion being the greater to permit axial telescoped application of said overcap to a closed container.

16. A container unit comprising a container having a product therein and closed by removable closure, and a tamper indicating overcap in the form of a preshaped collar telescoped over a lower portion of said closure and an upper portion of said container, said collar having an upper portion without change in shape or size adhesively bonded to said closure lower portion and a lower portion adhesively bonded to said container upper portion without change in shape or size adhesively bonded to said container upper portion without change in shape or size, said collar also including an intermediate portion integrally joining together said collar upper and lower portions, said intermediate portion having a line of weakening for separating said collar upper and lower portions in response to removal of said closure from said container, and means for irreversibly indicating manipulation of the line of weakening.

17. A container unit according to claim 16 wherein said adhesive is initially encased in microcapsules.

18. A container unit according to claim 16 wherein said overcap includes a coating of microcapsules containing a color forming dye whereby when said overcap is ruptured, ruptured portions of said overcap automatically become stained.

19. A container unit according to claim 18 wherein said coating of microcapsules containing a color forming dye is in three parts, one part being located along said line of weakening, one part being located adjacent where said collar upper portion is bonded to said closure, and one part being located adjacent where said collar lower portion is bonded to said container.

20. A tamper-evident overcap for application to a closed container including a removable closure, said overcap being in the form of a preshaped collar including an upper portion of a size and shape to be bonded to a closure without change in size or shape, a lower portion of a size and shape to be bonded to a container without change in size or shape, and an intermediate portion integrally joining said upper and lower portions, and said intermediate portion having a line of weakening for separating said upper portion from said lower portion when said upper portion is to be removed, said upper and lower portions having internal surfaces carrying an adhesive for separately bonding said overcap to a container and a closure for such container, said overcap including a coating of microcapsules containing a color forming dye whereby when said overcap is ruptured, ruptured portions of said overcap automatically become stained, said coating of microcapsules forming a dye being in three parts, one part being located along said line of weakening, one part being located along said internal surface of said upper portion carrying an adhesive and one part being located along said internal surface of said lower portion carrying an adhesive.

* * * * *